US010525751B2

(12) United States Patent
Okazawa et al.

(10) Patent No.: US 10,525,751 B2
(45) Date of Patent: Jan. 7, 2020

(54) LIQUID EJECTING APPARATUS

(71) Applicant: SEIKO EPSON CORPORATION, Tokyo (JP)

(72) Inventors: Yoshiyuki Okazawa, Shiojiri (JP); Atsuhiko Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/232,206

(22) Filed: Dec. 26, 2018

(65) Prior Publication Data

US 2019/0193438 A1 Jun. 27, 2019

(30) Foreign Application Priority Data

Dec. 27, 2017 (JP) ..... 2017-250715

(51) Int. Cl.
*B41J 2/175* (2006.01)
*B41J 29/13* (2006.01)
*B41J 29/02* (2006.01)

(52) U.S. Cl.
CPC ..... *B41J 29/13* (2013.01); *B41J 2/1752* (2013.01); *B41J 2/17506* (2013.01); *B41J 2/17509* (2013.01); *B41J 2/17523* (2013.01); *B41J 2/17553* (2013.01); *B41J 29/02* (2013.01)

(58) Field of Classification Search
CPC .... B41J 2/175; B41J 2/17506; B41J 2/17509; B41J 2/1752; B41J 2/17523; B41J 29/02; B41J 29/13; B41J 2/17553
See application file for complete search history.

(56) References Cited

U.S. PATENT DOCUMENTS 9,421,781 B2 * 8/2016 Kimura ..... B41J 2/17509
2008/0297571 A1 * 12/2008 Umeda ..... B41J 2/17509 347/85
2012/0038719 A1 * 2/2012 Shimizu ..... B41J 2/17523 347/86
2017/0057235 A1 3/2017 Suzuki et al.

FOREIGN PATENT DOCUMENTS

JP 2017-042995 A 3/2017

* cited by examiner

*Primary Examiner* — Anh T Vo
(74) *Attorney, Agent, or Firm* — Workman Nydegger

(57) ABSTRACT

In a liquid ejecting apparatus, a cover member, which is provided so that a part thereof is located in an external region of a housing and is displaceable between a closed position where a pouring port pouring a liquid is not exposed and an opened position where the pouring port is exposed, is at a position different from a position where the cover member overlaps an apparatus main body in a case where the apparatus main body is viewed from an upper surface of an image reading device at the opened position, and a liquid containing portion is provided at a position where at least a part of a liquid replenishment member connected to the pouring port overlaps the image reading device in a case where the apparatus main body is viewed from the side surface when the cover member is located at the opened position.

6 Claims, 7 Drawing Sheets

LIQUID EJECTING APPARATUS

BACKGROUND

1. Technical Field

The present invention relates to a liquid ejecting apparatus such as a printer.

2. Related Art

An ink jet type printer (liquid ejecting apparatus) including a liquid ejecting unit that ejects ink, which is an example of a liquid, to a sheet as an example of a medium has been known from the past. Some of such printers include an ink tank (liquid containing body) that contains ink to be supplied to the liquid ejecting unit contained in an apparatus main body. The ink tank is provided with a blocking member for blocking a pouring port in order to prevent the ink contained in the ink tank from leaking from the pouring port. For example, JP-A-2017-42995 discloses a printer in which a blocking member that blocks a pouring port of an ink tank is attached to a cover member that can open and close a liquid containing portion that contains the ink tank.

In a printer disclosed in JP-A-2017-42995, an upper portion of an apparatus main body is configured to include an image reading device. A liquid containing portion is disposed at a position which is a corner on one of the right and left sides of a front surface of the apparatus main body, and a cover member is disposed below the image reading device. Therefore, in order to pour ink into an ink tank, it is necessary that the image reading device pivots to be located at an opened position and then the cover member is located at the opened position, which is troublesome. In this regard, in order to enable the cover member to be located at the opened position without being locating the image reading device at the opened position, it is considered that the entire liquid containing portion is located in an external region of the apparatus main body which is located outside the front surface or the side surface forming an outline of the apparatus main body; however, in this case, there is a problem that the apparatus main body becomes large.

SUMMARY

An advantage of some aspects of the invention is to provide a liquid ejecting apparatus capable of preventing the apparatus main body from being large.

Hereinafter, means of the invention and operation effects thereof will be described.

According to an aspect of the invention, there is provided a liquid ejecting apparatus including a liquid ejecting unit that ejects a liquid to a medium; an apparatus main body that includes a housing for containing at least the liquid ejecting unit, and an image reading device disposed on an upper surface of the housing, in which an outer surface thereof has an upper surface and a front surface adjacent and intersecting with the upper surface, and a side surface adjacent and intersecting with the front surface and the upper surface; a liquid containing portion in which a part thereof is located in an external region of the housing, and a pouring port capable of containing the liquid supplied to the liquid ejecting unit to the inside and pouring the liquid from outside; and a cover member capable of being displaced between a closed position at which the pouring port is not exposed and an opened position at which the pouring port is exposed, in which in a state of being located at the opened position, the cover member is at a position different from a position where the cover member overlaps the apparatus main body in a case where the apparatus main body is viewed from the upper surface side of the image reading device, and the liquid containing portion is provided at a position where at least a part of a liquid replenishment member connected to the pouring port overlaps the image reading device in a case where the apparatus main body is viewed from the side surface side in a state in which the cover member is located at the opened position.

According to this configuration, a part of the liquid containing portion is located in the external region of the housing, and thus the liquid containing portion protrudes outward from a contour of the housing. In such a liquid ejecting apparatus, at the time of connecting the pouring port of the liquid containing portion and the liquid replenishment member to each other, when at least a part of the liquid replenishment member overlaps the image reading device in a case where the apparatus main body is viewed from the side surface side, as compared with a case where a part of the liquid replenishment member does not overlap the image reading device, it is possible to reduce the amount of protrusion of the liquid containing portion from the housing and to suppress the increase in the size of the apparatus main body in this point.

In the liquid ejecting apparatus, the apparatus main body is preferably provided with a guide portion which is in contact with the liquid replenishment member connected to the pouring port so make a liquid supply portion provided in the liquid replenishment member face the pouring port.

According to this configuration, at the time of connecting the pouring port of the liquid containing portion and the liquid supply portion of the liquid replenishment member, when bringing the liquid replenishment member into contact with the guide portion, the liquid supply portion of the liquid replenishment member can be opposed to the pouring port of the liquid containing portion and an operation of connecting the liquid supply portion of the liquid replenishment member to the pouring port of the liquid containing portion is facilitated.

In the liquid ejecting apparatus, it is preferable that the liquid replenishment member include a cylindrical bottle main body, and the guide portion have an arcuate recessed portion in a case of being viewed from the upper surface side.

According to this configuration, by making the outer peripheral surface of the bottle main body along the recessed portion of the guide portion, the operation of connecting the liquid supply portion of the liquid replenishment member to the pouring port of the liquid containing portion is facilitated.

In the liquid ejecting apparatus, it is preferable that an operation unit for operating the liquid ejecting apparatus be provided on an upper portion of the front surface which corresponds to a top surface of the apparatus main body, and in a case where the apparatus main body is viewed from the side surface side in a state where the cover member is located at the opened position, the liquid containing portion be provided at a position where at least a part of the liquid replenishment member connected to the pouring port overlaps the operation unit.

According to this configuration, a region for providing the operation unit can be used to reduce the protrusion amount of the liquid containing portion from the housing.

In the liquid ejecting apparatus, it is preferable that the cover member include a blocking member for blocking the pouring port by coming into contact with the pouring port in a state of being located at the closed position, the blocking member be integral with a mounting member mounted on a mounting surface of the cover member, the mounting member be fixed with a clearance between a pair of fixing portions provided on the mounting surface of the cover member, the cover member be pivotably supported by a key slot which integrally holds a plurality of liquid containing bodies each of which has the pouring port and which is contained in the liquid containing portion, and has an insertion hole into which the liquid replenishment member is inserted so as to face the liquid containing body.

According to this configuration, the key slot is a member which integrally holds the plurality of liquid containing bodies having the pouring port, and is provided with the insertion hole into which the liquid replenishment member is inserted when the liquid replenishment member is connected to the pouring port of the liquid containing body. That is, the key slot is a member for determining a position of the pouring port of the liquid containing body. Since the cover member is pivotably supported by the key slot that determines the position of the pouring port, when the cover member is displaced from the opened position to the closed position, the blocking member integral with the cover member is easily brought into contact with the pouring port. Further, since the mounting member having the blocking member integrated therewith has a clearance between the fixing portions, the position of the blocking member can be adjusted to the pouring port by using the clearance.

In the liquid ejecting apparatus, it is preferable that on the front surface corresponding to a top surface of the apparatus main body, an opening for exposing the inside of the housing be provided, and a front cover displaceable between a closed state in which the opening is closed and an opened state in which the opening is opened be pivotably supported, the cover member be provided with an engagement portion, and the front cover be provided with an engaged portion engageable with the engagement portion, and the engagement portion be engaged with the engaged portion when the cover member is displaced from the closed position to the opened position.

With this configuration, as the cover member is displaced from the closed position to the opened position, the engagement portion engages with the engaged portion, so that the front cover can be displaced to be in the closed state to the opened state.

BRIEF DESCRIPTION OF THE DRAWINGS

The invention will be described with reference to the accompanying drawings, wherein like numbers reference like elements.

DESCRIPTION OF EXEMPLARY EMBODIMENTS

One embodiment of a liquid ejecting apparatus will be described below with reference to the drawings.

Figure 1:
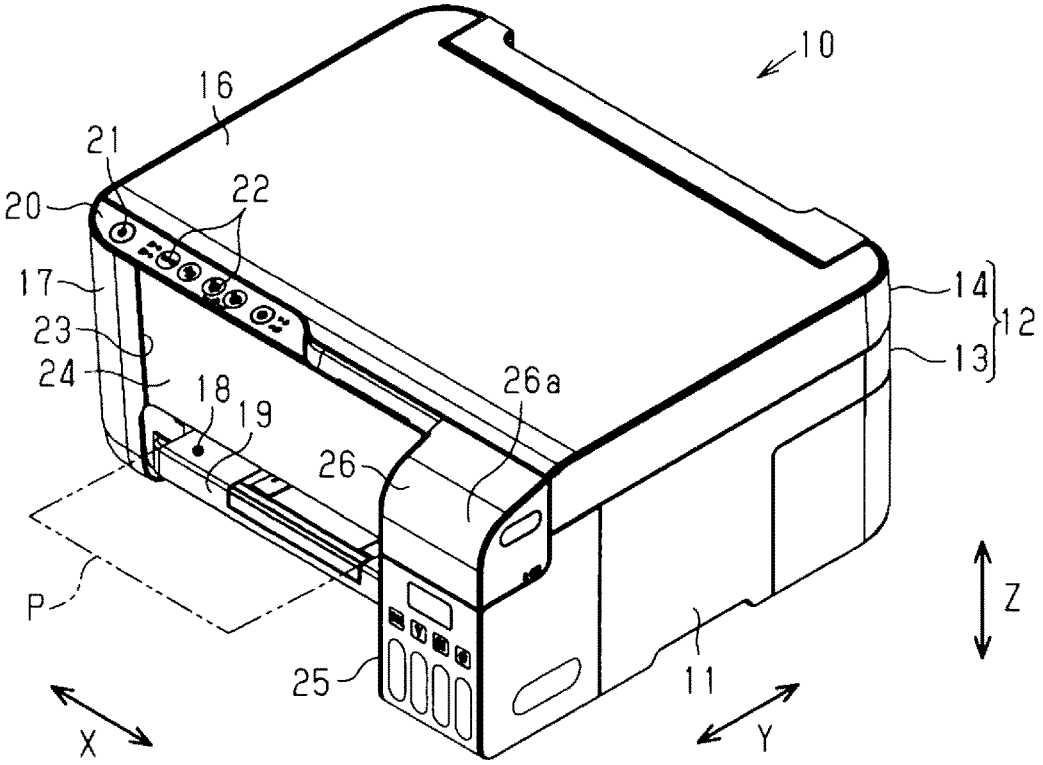
FIG. 1 is a perspective view illustrating a liquid ejecting apparatus of one embodiment.

As illustrated in FIG. 1, a liquid ejecting apparatus 10 of the embodiment is an ink jet type printer that performs recording by ejecting ink, which is an example of a liquid, on a medium P such as a sheet, and is provided with a substantially rectangular parallelepiped apparatus main body 12 having a predetermined length as a height, a depth, and a width, respectively in a state of being installed in a horizontal use place. In FIG. 1, assuming that the liquid ejecting apparatus 10 is placed on a horizontal plane, a vertical direction is indicated by a Z axis, and a direction along the horizontal plane perpendicular to the vertical direction is indicated by an X axis and a Y axis. In the following description, the direction along the X axis is also referred to as a width direction, the direction along the Y axis is also referred to as a depth direction, and the width direction, the depth direction, and the vertical direction intersect with (preferably orthogonal to) each other.

Figure 2:
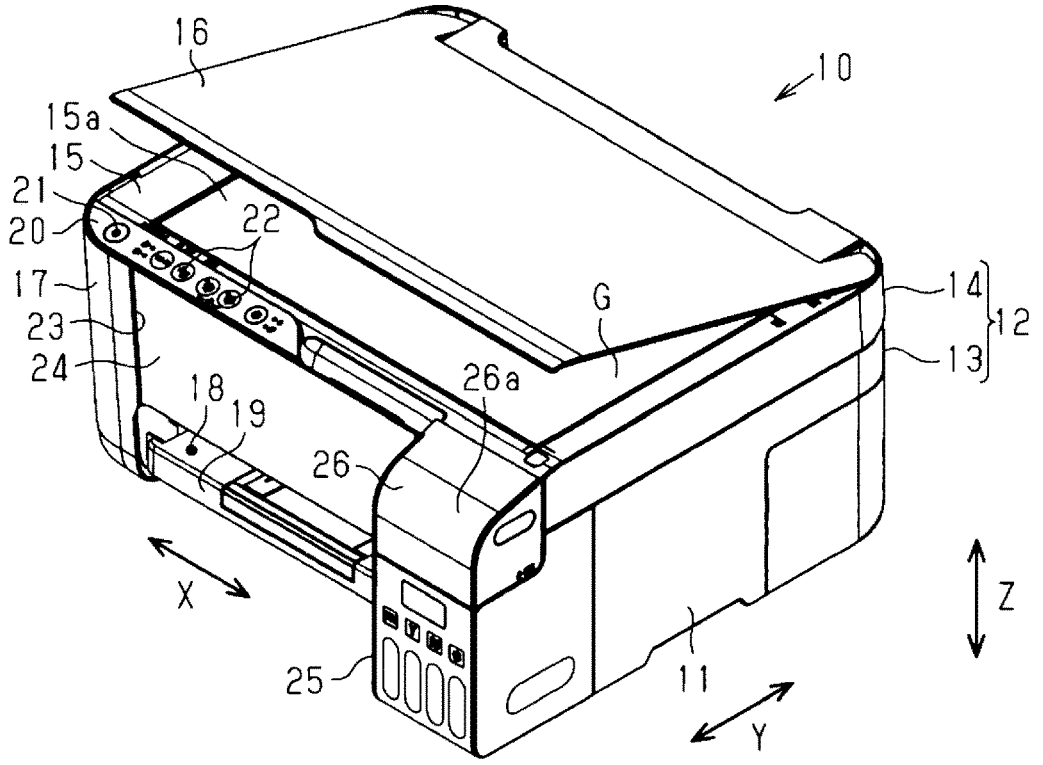
FIG. 2 is a perspective view illustrating the liquid ejecting apparatus in a state in which a document cover is opened.

As illustrated in FIGS. 1 and 2, the apparatus main body 12 is provided with a substantially rectangular parallelepiped housing 13 and a document reading device 14 as an image reading device disposed on the upper surface of the housing 13. The document reading device 14 is provided with a document table 15 including a horizontal document placement surface 15*a* made of transparent glass G on which a document for reading is placed, and a document cover 16 capable of covering the document placement surface 15*a*. The document cover 16 is provided to be openable and closable about the X axis extending along the width direction as a pivot center between in a closed state (a state illustrated in FIG. 1) in which the document placement surface 15*a* is covered from above and an opened state (a state illustrated in FIG. 2) in which an upper region of the document placement surface 15*a* is opened from the closed state. In this case, the document placement surface 15*a* of the document reading device 14 constitutes an upper surface facing the upper side in the vertical direction among a plurality of (in this case, six) outer surfaces of the apparatus main body 12. The apparatus main body 12 includes a front surface 17 that intersects adjacent to the upper surface, and a side surface 11 that intersects adjacent to the document placement surface 15*a* and the front surface 17 and is on the outer surface located on both sides in the width direction. The direction from the front surface 17 of the apparatus main body 12 toward the back is the depth direction.

A discharge port 18 for discharging the medium P from the inside is provided below the front surface 17 which is the top surface of the apparatus main body 12. A stacker 19 for supporting the medium P discharged toward the near side in the depth direction from the inside of the housing 13 in a placed state is provided inside the discharge port 18. In addition, an operation unit 20 that performs an operation of the liquid ejecting apparatus 10 is provided above the front surface 17 of the apparatus main body 12. The operation unit 20 is a horizontally elongated panel whose width direction is the longitudinal direction, and is provided with a power button 21 operated when the liquid ejecting apparatus 10 is turned on or off, and an operation button 22 operated when inputting various kinds of operation information.

Figure 3:
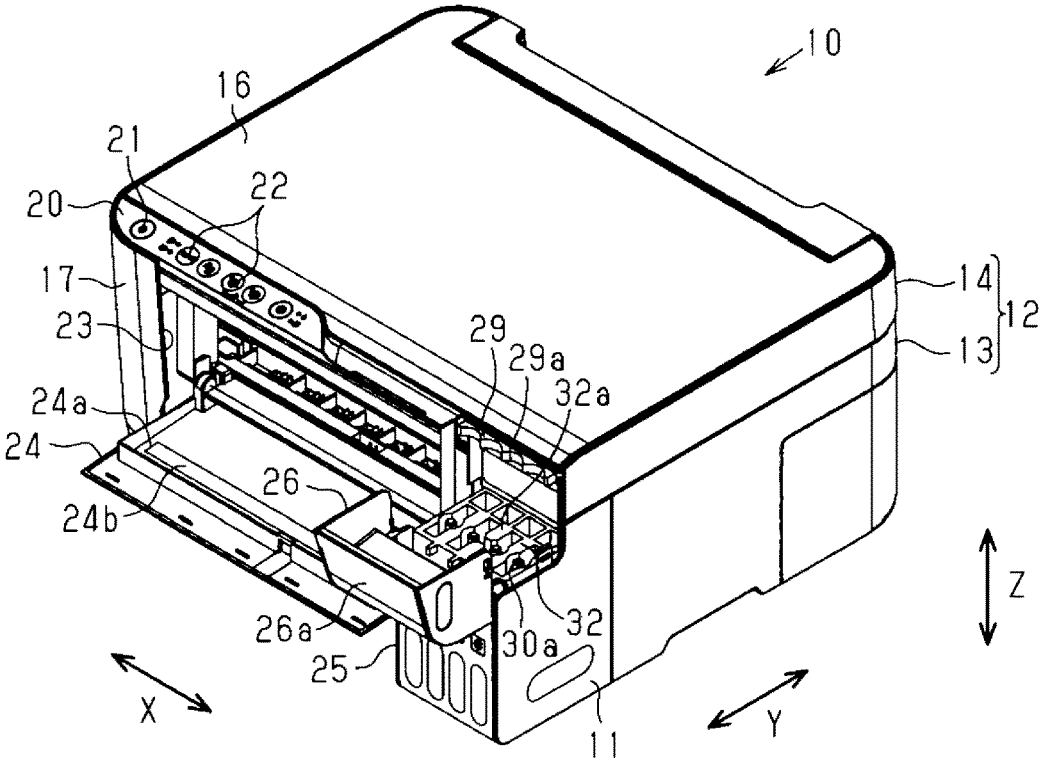
FIG. 3 is a perspective view illustrating the liquid ejecting apparatus in a state in which a front cover and the cover member are opened.

As illustrated in FIG. 3, in the front surface 17 of the apparatus main body 12, an opening 23 which has a rectangular shape whose length in the width direction is substantially the same as the discharge port 18 and exposes the interior of the housing 13 is provided at a position between the discharge port 18 and the operation unit 20 in the vertical direction. On the front surface 17 of the apparatus main body 12, a rectangular front cover 24 whose top surface shape is substantially the same as the opening 23 is provided displaceable about the X axis as a pivot center between the closed state (the state illustrated in FIG. 1) in which the opening 23 is blocked, and an opened state (a state of FIG. 3) in which the opening 23 is opened. In a case where the front cover 24 is opened, the user can insert a hand into the housing 13 via the opening 23 for maintenance or the like. In the front cover 24, on a flat portion of the back surface 24*a* exposed to the outside in the opened state, a notice label 24*b* at the time of pouring the liquid into a liquid containing body 30 to be described later is affixed. The front cover 24 is configured to be displaceable from the closed state illustrated in FIG. 1 to the opened state illustrated in FIG. 3 by pivoting the upper end portion to the front side with the lower end portion of the front cover 24 as a pivot point.

As illustrated in FIGS. 1 and 3, a liquid containing portion 25 in the form of a tank capable of containing a liquid such as ink is provided at a position adjacent to the front cover 24 in the width direction of the front surface 17 of the apparatus main body 12. The liquid containing portion 25 is provided at a position adjacent to one side in the width direction (the right side in FIGS. 1 and 3) with respect to the front cover 24 in a case where the liquid ejecting apparatus 10 is viewed from the top surface. A part of the liquid containing portion 25 is provided so as to protrude to the front side which is the near side in the depth direction from the front cover 24 on the front surface 17 of the apparatus main body 12. That is, the liquid containing portion 25 is provided so that a part thereof is located in an external region of the housing 13 constituting the apparatus main body 12.

Above the liquid containing portion 25, a cover member 26 is provided to be displaceable between two positions of an opened position (refer to FIG. 3) at which the upper portion of the liquid containing portion 25 is opened and a closed position (refer to FIG. 1) at which the upper portion of the liquid containing portion 25 is not exposed. The cover member 26 will be described below in detail.

Figure 4:
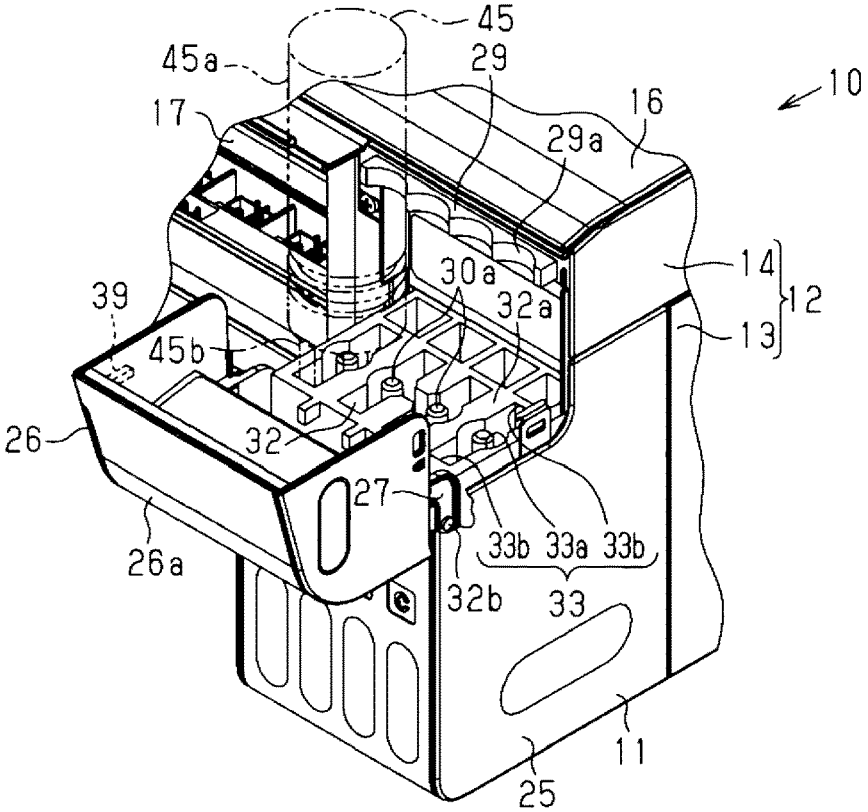
FIG. 4 is a perspective view illustrating a liquid containing portion in a state in which the cover member is at an opened position.

As illustrated in FIGS. 3 and 4, in a state in which the cover member 26 is in the opened position, a guide portion 29 is provided at a position which is adjacent to the front cover 24 in the width direction and is above the liquid containing portion 25, on the front surface of the document reading device 14. The guide portion 29 is at a position retracted to the rear side which is the depth side in the depth direction from the front surface 17 of the apparatus main body 12. The guide portion 29 is provided with a plurality of (four in the embodiment) recessed portions 29*a* in the width direction. In a case where the liquid ejecting apparatus 10 is viewed from the upper surface side of the apparatus main body 12, the recessed portion 29*a* is provided so as to be recessed in a circular arc shape toward the depth side in the depth direction. In addition, in a case where the liquid ejecting apparatus 10 is viewed from the side surface 11 on which the liquid containing portion 25 is located, the guide portion 29 is provided at a position overlapped with the operation unit 20. That is, the guide portion 29 does not protrude forward from the front surface 17 of the apparatus main body 12.

Figure 5:
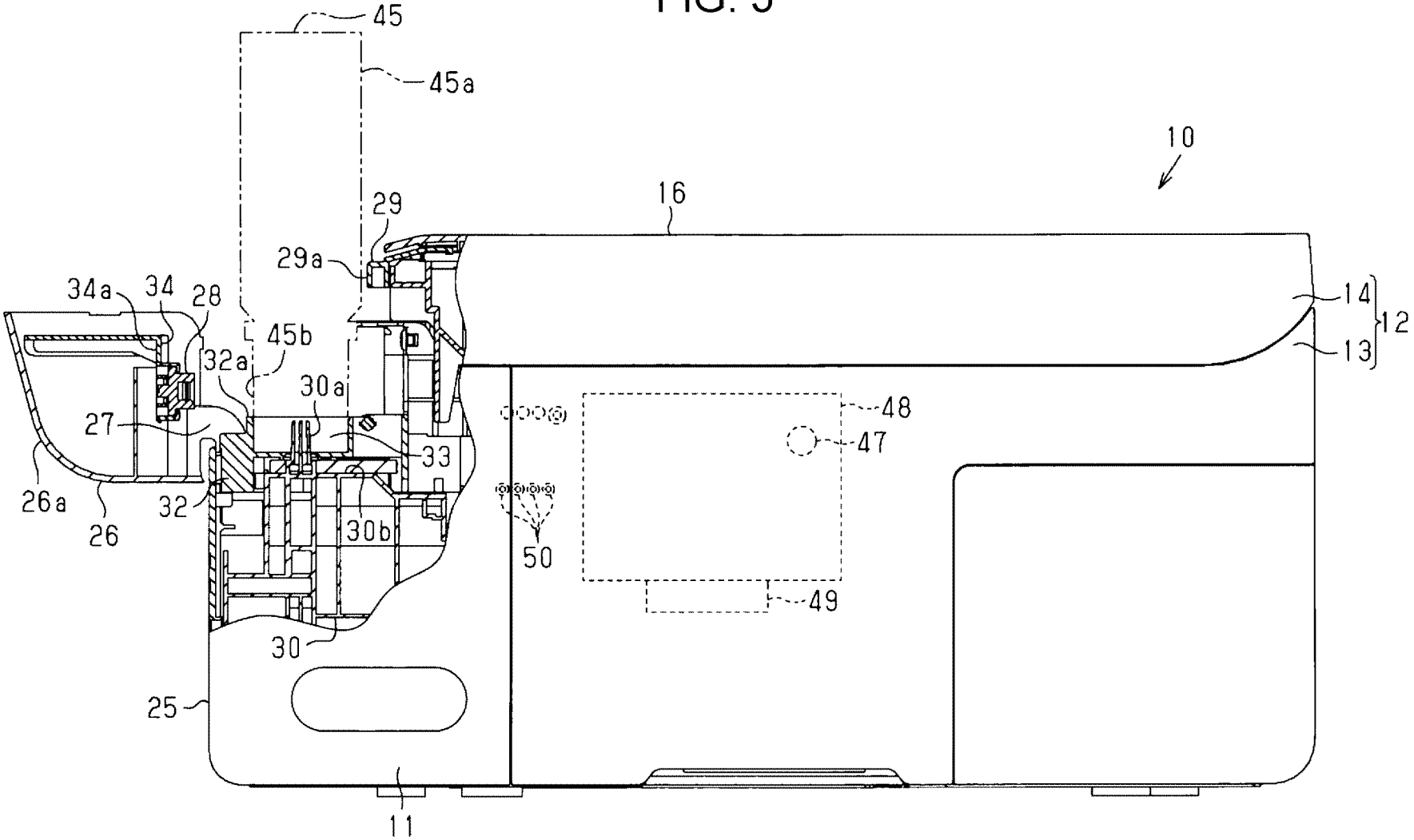
FIG. 5 is a partially broken side view illustrating a liquid ejecting apparatus in a state in which the cover member is at an opened position.

As illustrated in FIG. 5, the liquid containing portion 25 contains a plurality (four in the embodiment) of liquid containing bodies 30. The liquid containing body 30 is configured as a so-called ink tank having a pouring port 30*a* that can store therein ink as a liquid to be supplied to a liquid ejecting head 49 described later and can inject ink from the outside. Therefore, the liquid containing portion 25 containing the liquid containing body 30 has the pouring port 30*a* that can store therein the ink as a liquid to be supplied to the liquid ejecting head 49 and can pour the ink from the outside. The liquid containing body 30 contains different kinds (for example, colors such as cyan, magenta, yellow, black, and colorants such as pigments and dyes). The pouring port 30*a* of the liquid containing body 30 is formed in a substantially cylindrical shape so as to protrude upward from the upper surface 30*b* of the liquid containing body 30.

As illustrated in FIG. 4, the plurality of liquid containing bodies 30 contained in the liquid containing portion 25 are integrally held by a covered quadrangular cylindrical key slot 32. When the cover member 26 is in the opened position, the upper surface 32*a* of the key slot 32 constitutes the upper surface of the liquid containing portion 25. The plurality of liquid containing bodies 30 are integrally held by the key slot 32. On the upper surface 32*a* of the key slot 32, a plurality (four in the embodiment) of insertion holes 33 are provided side by side in the width direction. The insertion hole 33 includes a circular first recessed portion 33*a* in a case where the liquid ejecting apparatus 10 is viewed from the upper surface side and a pair of substantially rectangle second recessed portions 33*b* which are connected to the first recessed portion 33*a* and are extended in mutually opposite directions from the first recessed portion 33*a*. The pouring port 30*a* of the liquid containing body 30 held by the key slot 32 is inserted through the first recessed portion 33*a*. A plurality of recessed portions 29*a* of the guide portion 29 are provided above the pouring ports 30*a* of the plurality of liquid containing bodies 30 held by the key slot 32.

In addition, in a case where the ink is to be poured into the liquid containing body 30 in order to replenish the ink in the liquid containing body 30, a liquid replenishment member 45 is inserted into the insertion hole 33. The liquid replenishment member 45 includes a bottomed cylindrical bottle main body 45*a* and a liquid supply portion 45*b* provided at the tip of the bottle main body 45*a* and having the same shape as that of the insertion hole 33. The curvature of the circular arc along the outer peripheral surface of the bottle main body 45*a* is substantially the same as the curvature of the circular arc of the recessed portion 29*a* of the guide portion 29. The guide portion 29 includes an arcuate recessed portion 29*a* along the outer peripheral surface of the bottle main body 45*a*. Therefore, when the liquid supply portion 45*b* of the liquid replenishment member 45 is inserted into the insertion hole 33 and the pouring port 30*a* of the liquid containing body 30 is inserted into the liquid supply portion 45*b*, the outer peripheral surface of the bottle main body 45*a* face the recessed portion 29*a* of the guide portion 29.

As illustrated in FIGS. 4 and 5, in a state in which the liquid supply portion 45*b* of the liquid replenishment member 45 is inserted into the insertion hole 33 of the liquid containing portion 25 and the pouring port 30*a* is inserted into the liquid supply portion 45*b*, in a case where the liquid ejecting apparatus 10 is viewed from the side surface 11 on which the liquid containing portion 25 is located, a part of the bottle main body 45*a* on the guide portion 29 side overlaps the document reading device 14 and the operation unit 20. That is, a part of the bottle main body 45*a* is at a position retracted further backward than the front surface 17 of the apparatus main body 12. Therefore, in a case where the apparatus main body 12 is viewed from the side surface 11 in a state in which the cover member 26 is located at the opened position, the liquid containing portion 25 is located at a position where a part of the guide portion 29 of the liquid replenishment member 45 connected to the pouring port 30*a* overlaps the document reading device 14 and the operation unit 20.

Figure 6:
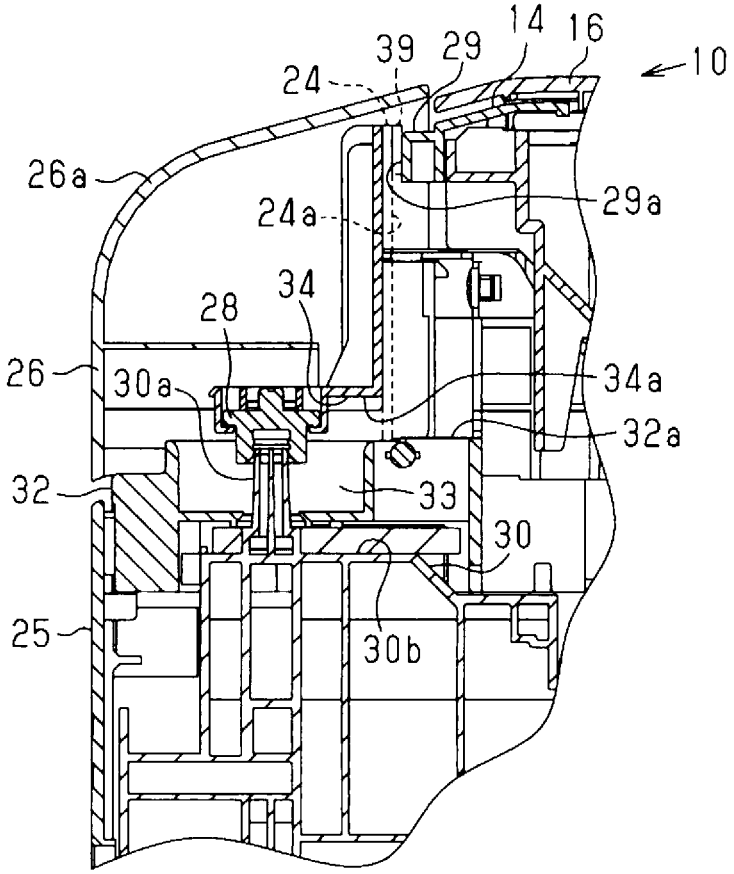
FIG. 6 is an enlarged sectional view illustrating a liquid containing portion in a state in which the cover member is at a closed position.

Next, the above-described cover member 26 will be described. The cover member 26 is displaceable between the closed position (refer to FIG. 1) where the pouring port 30*a* of the liquid containing body 30 is not exposed and the opened position (refer to FIG. 3) where the pouring port 30*a* is exposed. As illustrated in FIG. 6, the cover member 26 is provided above the liquid containing portion 25, which is a position where the key slot 32 can be covered from above. The cover member 26 includes an exterior surface 26*a* which is flush with the front surface of the liquid containing portion 25 in a state of being located at the closed position and constitutes a part of the exterior of the liquid ejecting apparatus 10. In a state in which the cover member 26 is located at the closed position, one surface of the cover member 26 facing the pouring port 30*a* exposed at the upper portion of the key slot 32 is brought into contact with the pouring port 30*a* so that a blocking member 28 for blocking the pouring port 30*a* is attached. That is, the one surface of the cover member 26 facing the pouring port 30*a* corresponds to a mounting surface 26*b* to which the blocking member 28 is attached.

Figure 7:
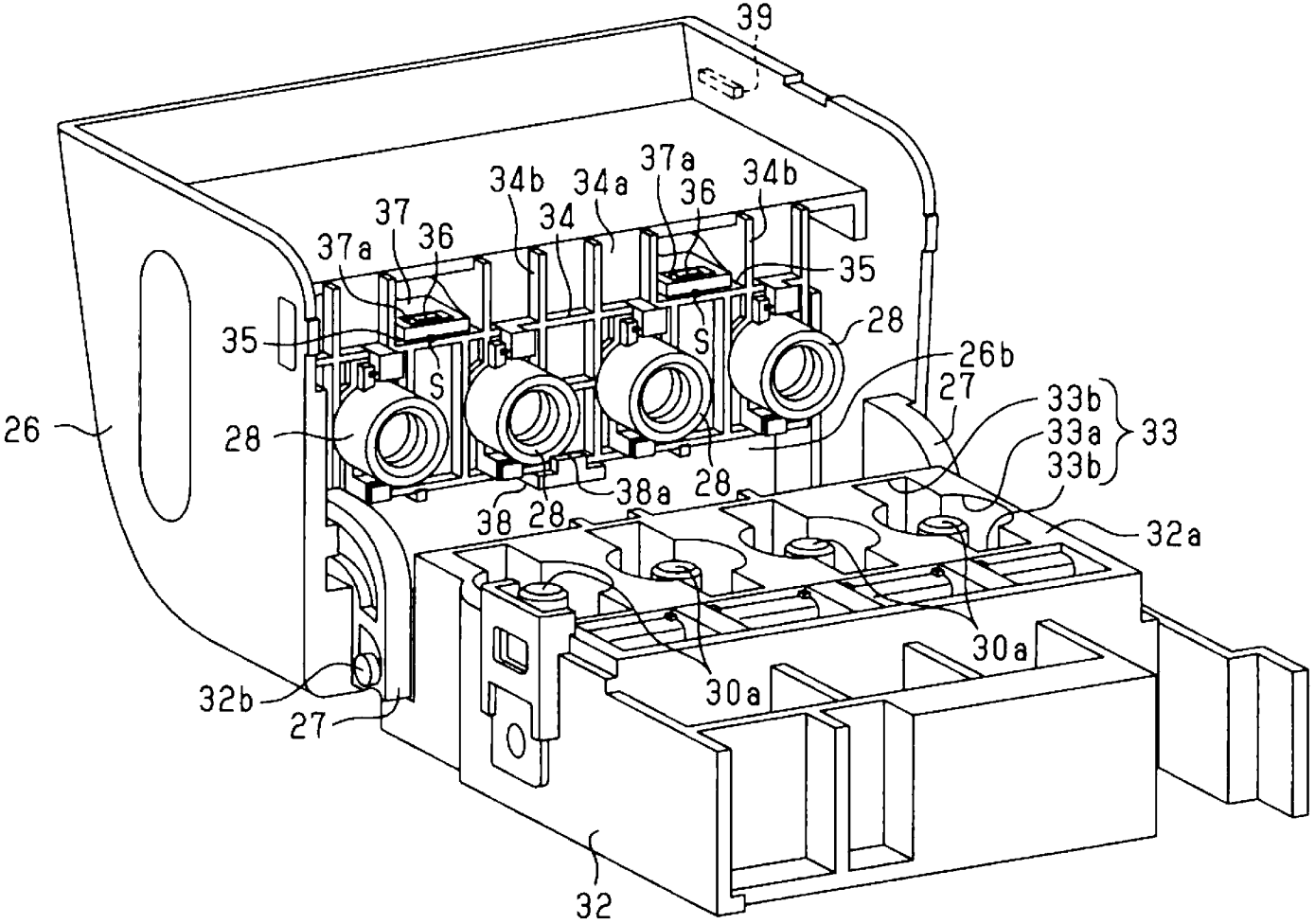
FIG. 7 is a partial perspective view illustrating a liquid containing portion in a state in which the cover member is at an opened position.

As illustrated in FIG. 7, the blocking member 28 is integrated with a mounting member 34 mounted on the mounting surface 26*b* of the cover member 26. The mounting member 34 is an L-shaped plate member, and a reinforcing rib 34*b* is formed on a plate portion 34*a* facing the mounting surface 26*b*. In the plate portion 34*a*, a pair of rectangular hole-shaped hollow portions 35 are formed on the L-shaped bent portion side of the mounting member 34. A locking claw 36 protruding toward the inside of the hollow portion 35 is provided on one edge portion close to the blocking member 28, among the inner edge portions of the respective hollow portions 35. A first fixing portion 37 protruding from the mounting surface 26*b* is inserted into each hollow portion 35 of the mounting member 34. A rectangular hole-shaped locking hole 37*a* is provided at the tip of each of the first fixing portions 37, and the locking claw 36 is locked to the inner peripheral edge of the locking hole 37*a*. The first fixing portion 37 constitutes one fixing portion of the pair of fixing portions.

Further, in the plate portion 34*a* of the mounting member 34, a locking protrusion 38*a* which is provided at the tip of a second fixing portion 38 protruding from the mounting surface 26*b* is locked at the edge portion which is the opposite side of the edge portion where the hollow portion 35 is formed. The second fixing portion 38 constitutes the other fixing portion of the pair of fixing portions, and the first fixing portion 37 and the second fixing portion 38 constitute a pair of fixing portions. The mounting member 34 is fixed to the cover member 26 by the locking of the locking claw 36 formed in the hollow portion 35 and the locking hole 37*a* of the first fixing portion 37, and the locking of the edge portion of the plate portion 34*a* and the locking protrusion 38*a* of the second fixing portion 38.

In the state in which the cover member 26 is located at the opened position, the second fixing portion 38 is located below the first fixing portion 37, and the mounting member 34 is supported from below by the second fixing portion 38 located thereunder. In the state in which the mounting member 34 is supported from below by the second fixing portion 38, a clearance S is formed between the first fixing portion 37 and the edge portion of the hollow portion 35, and the mounting member 34 is allowed to move between the first fixing portion 37 and the second fixing portion 38 only by the area of the clearance S.

A plurality (four in the embodiment) of blocking members 28 mounted to the mounting member 34 are provided according to the number of the liquid containing bodies 30 to be contained in the liquid containing portion 25. That is, the plurality of blocking members 28 are provided on the cover member 26 according to the number of pouring ports 30*a*, and one blocking member 28 blocks one pouring port 30*a*. The blocking member 28 attached to the mounting member 34 has a substantially cylindrical shape and is made of an elastically deformable elastic member (for example, elastomer such as rubber). Further, the blocking member 28 is detachably provided to the mounting member 34.

A bearing 27 protruding in an arcuate shape toward the outside of the cover member 26 is formed at a position close to the mounting surface 26*b* of the side surface that sandwiches the exterior surface 26*a* of the cover member 26 in the width direction. A columnar shaft 32*b* extending along the width direction is formed at a position on the front side of both side surfaces in the width direction of the key slot 32.

In addition, as the bearing 27 of the cover member 26 rotatably supports the shaft 32*b* of the key slot 32 so as to pivotably support the cover member 26 with respect to the key slot 32 around the shaft 32*b*. As the cover member 26 pivots toward the front of the apparatus main body 12, the cover member 26 is displaced from the closed position to the opened position. In other words, the cover member 26 is configured to be displaced from the closed position illustrated in FIG. 1 to the opened position illustrated in FIG. 3 when the rear end portion of the cover member 26 pivots to the front side with the lower portion on the front end side as a pivot point.

The opened position of the cover member 26 is located at a position different from the position overlapped with the apparatus main body 12 in a case where the apparatus main body 12 is viewed from the upper surface side of the document reading device 14, that is, in front of the apparatus main body 12, and the cover member 26 is positioned in front of the front surface 17 of the apparatus main body 12.

An engagement portion 39 extending in the width direction from the cover member 26 is formed on the side of the front cover 24, among the side surfaces that sandwich the exterior surface 26*a* of the cover member 26 from the width direction. The engagement portion 39 is linearly extended in the vertical direction in a state where the cover member 26 is in the closed position. As illustrated in FIG. 6, in a state where the cover member 26 is located in the closed position and the front cover 24 is in the closed state, the engagement portion 39 engages with the back surface 24*a* of the front cover 24 in the depth direction. When the cover member 26 located at the closed position is displaced to the opened position, the engagement portion 39 is engaged with the back surface 24*a* of the front cover 24. Therefore, in the embodiment, the back surface 24*a* of the front cover 24 constitutes an engaged portion to which the engagement portion 39 is engaged. As the cover member 26 is displaced from the closed position to the opened position, the engagement portion 39 engages with the back surface 24*a* of the front cover 24, so that the front cover 24 can be displaced to be in the opened state from the closed state.

As illustrated in FIG. 5, a guide shaft 47 is installed inside the housing 13 so as to be extended in the width direction, and a carriage 48 is supported by the guide shaft 47 to be reciprocable in the width direction along the X axis. The liquid ejecting head 49 which is an example of a liquid ejecting unit that performs recording on the medium P by ejecting a liquid toward the medium P to be transported is attached to the lower surface side of the carriage 48, and the liquid ejecting head 49 is housed in the housing 13.

Figure 8:
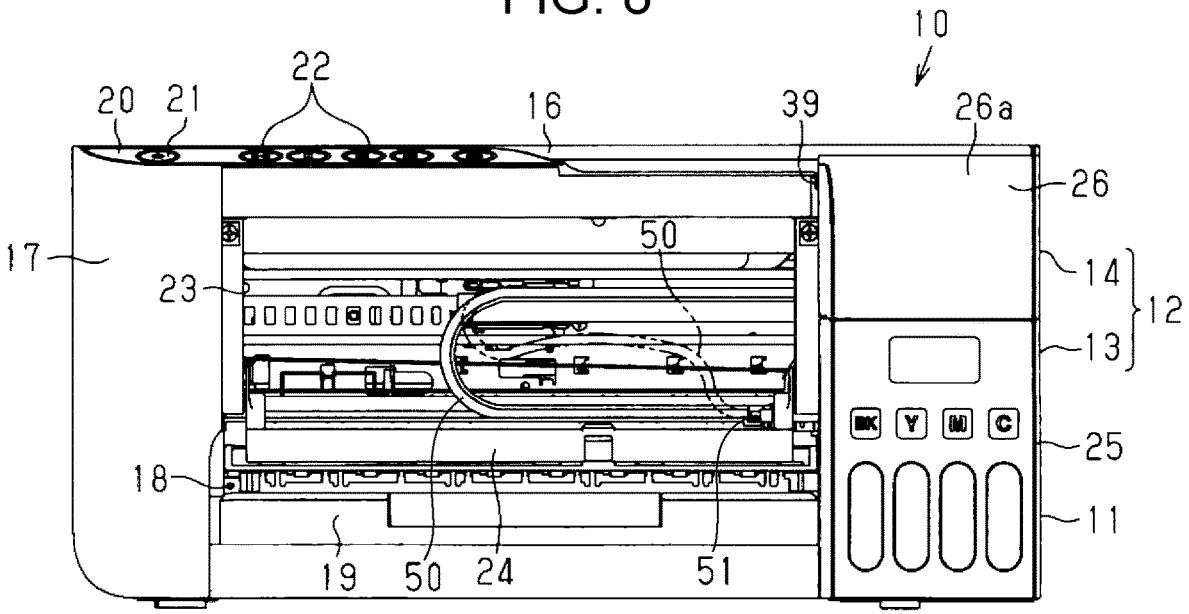
FIG. 8 is a top view illustrating a liquid ejecting apparatus in a state in which the front cover is opened.

In FIG. 8, the carriage 48 and the respective liquid containing bodies 30 are not shown, but the carriage 48 and the liquid containing body 30 are connected through a tube 50, and ink (liquid) is supplied from the liquid containing body 30 to the carriage 48 via the tube 50. A plurality (four in the embodiment) of the tubes 50 are arranged so as to be extended in the width direction on the depth side from the opening 23 in the housing 13. One end of each of the plurality of tubes 50 is connected to each of the liquid containing bodies 30, and the other end thereof is connected to the carriage 48. In a state in which the carriage 48 is located on the side of the liquid containing portion 25 in the width direction, the plurality of tubes 50 are in a state of being bent in a U shape in a case where the liquid ejecting apparatus 10 is viewed from the front surface. Among the plurality of tubes 50, one located on the liquid containing portion 25 side in the lower portion of the U shape is fixed to the housing 13 by a tube presser 51. The tube presser 51 is disposed at a position closest to the liquid containing portion 25 when viewed from the top surface of the opening 23. On the other hand, in the plurality of tubes 50, the other one located on the side closer to the carriage 48 than the tube presser 51 is not pressed against the housing 13 by the tube presser 51 and can be freely deformed as indicated by the two-dot chain line in FIG. 8.

Then, when the user inserts his or her hand into the housing 13 in a state in which the front cover 24 is in the opened state and the inside of the housing 13 of the apparatus main body 12 is visible through the opening 23, the plurality of tubes 50 can be displaced on the carriage 48 side relative to the tube presser 51. Therefore, the tube 50 does not become an obstacle, and the medium P clogged due to wrinkles can be removed by inserting a hand through the opening 23.

Figure 9:
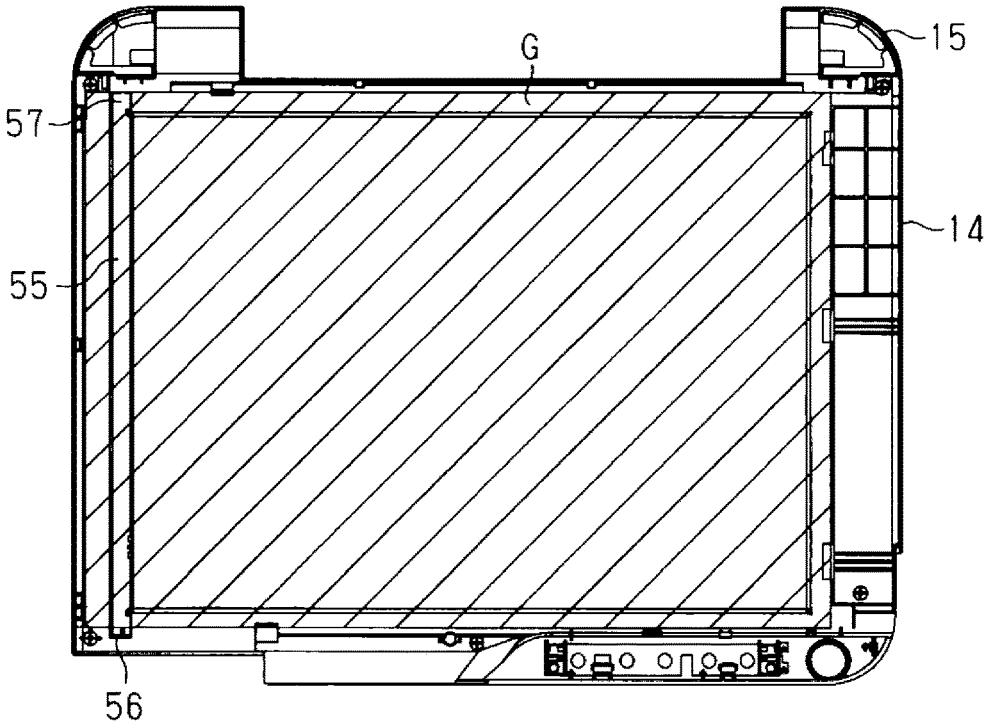
FIG. 9 is a bottom view illustrating a document reading device from the glass side.

As illustrated in FIG. 9, the document table 15 of the document reading device 14 has a rectangular frame shape. The surface of the glass G is exposed on the surface of the document table 15 to form the document placement surface 15*a*. On the other hand, on the back surface of the document table 15, a white reference plate 55 including a uniform reflective surface with high reflectivity is disposed at a position at which a reading portion which is not shown on a movement path of the carriage 48 in the X axis direction. The white reference plate 55 is an object to be read when obtaining white reference data used for shading correction.

The white reference plate 55 is read when a white reference reading execution condition is satisfied when a document reading operation (scanning operation) is performed. The white reference plate 55 is disposed on the upper surface at the end portion of a glass G (hatched for easy identification with other members in FIG. 9) extending from the inner edge of the document table 15 toward the outer edge in the width direction. The white reference plate 55 has a rectangular plate shape whose longitudinal direction extends in the depth direction of the apparatus main body 12.

Figure 10:
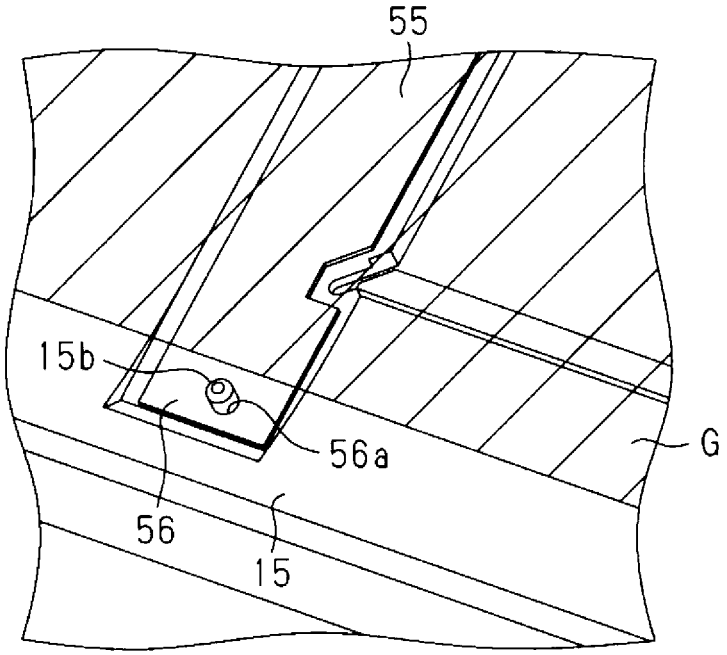
FIG. 10 is an enlarged perspective view illustrating a first end portion of a white reference plate.

As illustrated in FIG. 10, the first end portion 56 located on the front surface side of the apparatus main body 12 in the white reference plate 55 protrudes toward the front surface 17 side of the apparatus main body 12 from the glass G. A fitting hole 56*a* is formed at the first end portion 56 that protrudes toward the front surface 17 side from the end portion of the glass G. A fitting protrusion 15*b* protruding from the document table 15 toward the housing 13 is fitted into the fitting hole 56*a*.

Figure 11:
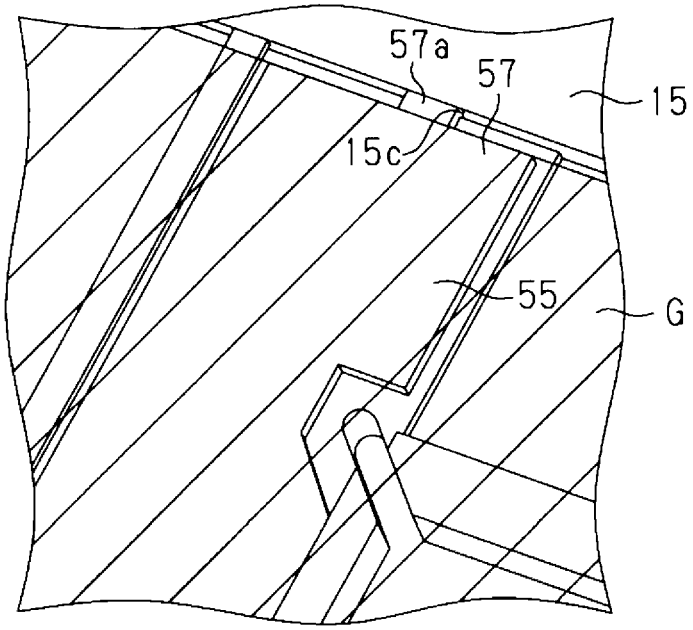
FIG. 11 is an enlarged perspective view illustrating a second end portion of the white reference plate.

As illustrated in FIG. 11, the second end portion 57 located on the rear surface side of the apparatus main body 12 in the white reference plate 55 is substantially at the same position as the end surface of the glass G. An engagement protrusion 57*a* protruding toward the document table 15 is formed from the second end portion 57. The engagement protrusion 57*a* is press-fitted into an engagement hole 15*c* formed at a position outside the end surface of the glass sheet G on the document table 15. The white reference plate 55 is assembled to the document table 15 by fitting of the fitting hole 56*a* and the fitting protrusion 15*b* and press fitting of the engagement protrusion 57*a* and the engagement hole 15*c*.

By assembling the white reference plate 55 to the document table 15 in this way, the hole formed in the document table 15 for assembling the white reference plate 55 to the document table 15 is only the engagement hole 15*c*. For example, compared with a case where the engagement protrusions 57*a* are provided on the first end portion 56 and the second end portion 57 of the white reference plate 55, and the engagement holes 15*c* are provided in the document table 15 so as to correspond to the respective engagement protrusions 57*a*, the number of holes formed in the document table 15 is reduced by one. Therefore, it is possible to reduce the possibility of dust entering into the document reading device 14 from the back surface side of the document table 15.

Next, the operation of the liquid ejecting apparatus 10 of the embodiment configured as described above will be described.

When replenishing ink into the liquid containing portion 25 of the liquid ejecting apparatus 10 using the liquid replenishment member 45, the cover member 26 located at the closed position is first displaced to the opened position. When displacing the cover member 26 to the opened position, the cover member 26 pivots about the shaft 32*b* (bearing 27) by pressing the exterior surface 26*a* of the cover member 26 forward, so that the pouring port 30*a* of the liquid containing body 30 is exposed from the upper surface of the key slot 32.

In this case, as illustrated in FIG. 5, as the cover member 26 is displaced to the opened position, the blocking member 28 in contact with the pouring port 30*a* is separated from the pouring port 30*a*, and the pouring port 30*a* is opened. That is, the cover member 26 covering the pouring port 30*a* of the liquid containing body 30, and the blocking member 28 for blocking the pouring port 30*a* are both separated from the pouring port 30*a*, and the pouring port 30*a* is opened such that the ink can be poured into the liquid containing body 30 by the operation of opening the cover member 26.

In addition, as the cover member 26 is displaced from the closed position to the opened position, the engagement portion 39 integral with the cover member 26 presses the back surface 24*a* of the front cover 24, and as illustrated in FIG. 3, the front cover 24 is displaced from the closed state to the opened state. Then, in the front cover 24 in the opened state, a notice label 24*b* is exposed from the flat portion of the back surface 24*a* exposed to the outside, and the user is urged to pay attention to the ink when replenishing the liquid containing body 30.

Then, the rear end portion of the cover member 26 pivots to the front side with the lower portion on the front end side as a pivot point. In a case where the apparatus main body 12 is viewed from the upper surface side, the cover member 26 at the opened position is located on the front side from the front surface 17 of the apparatus main body 12.

In such a state, as illustrated in FIG. 4, the pouring port 30*a* of the liquid containing body 30 is inserted into the liquid supply portion 45*b* of the liquid replenishment member 45. Specifically, the outer peripheral surface of the bottle main body 45*a* of the liquid replenishment member 45 is made to be along the recessed portion 29*a* of the guide portion 29 corresponding to the liquid containing body 30 to which the ink is replenished from the liquid replenishment member 45 in the liquid containing portion 25. As such, the pouring port 30*a* of the liquid containing body 30 for replenishing ink faces directly under the liquid supply portion 45*b* of the liquid replenishment member 45. When the liquid replenishment member 45 is moved toward the liquid containing portion 25 while keeping the liquid replenishment member 45 in contact with the recessed portion 29*a*, the liquid supply portion 45*b* is inserted into the insertion hole 33 and the pouring port 30*a* is inserted into the liquid supply portion 45*b*.

In addition, when the pouring of the ink into the liquid containing body 30 is completed, in order to suppress the drying of the ink and the mixing of dust in the air into the ink in the liquid containing body 30 via the pouring port 30*a*, the pouring port 30*a* is blocked by the blocking member 28, and the closed pouring port 30*a* is covered with the cover member 26.

As illustrated in FIG. 6, when the cover member 26 is displaced from the opened position to the closed position, the cover member 26 covers the pouring port 30*a* and the blocking member 28 contacts the pouring port 30*a* such that the pouring port 30*a* is blocked by only the operation of closing the cover member 26. Therefore, in the liquid ejecting apparatus 10, opening and closing of the pouring port 30*a* by the blocking member 28 are performed in conjunction with the opening and closing operation of the cover member 26 that covers the pouring port 30*a* of the liquid containing body 30.

The mounting member 34 to which the blocking member 28 is mounted is movable between the first fixing portion 37 and the second fixing portion 38 by only the area of the clearance S. When displacing the cover member 26 from the opened position to the closed position, the first fixing portion 37 and the second fixing portion 38 are arranged in the direction in which the cover member 26 pivots, and thus the mounting member 34 is displaceable between the first fixing portion 37 and the second fixing portion 38 in a direction in which the cover member 26 pivots. For this reason, even if the position of the blocking member 28 is slightly shifted with respect to the pouring port 30*a*, due to a slight movement of the mounting member 34 when the blocking member 28 is in contact with the pouring port 30*a*, the blocking member 28 is not shifted any more with respect to the pouring port 30*a* such that the pouring port 30*a* can be blocked by the blocking member 28.

As described above, according to the embodiment, the following effects can be obtained.

(1) In the liquid ejecting apparatus 10, a part of the liquid containing portion 25 is located in the external region of the housing 13, and thus the liquid containing portion 25 protrudes outward from a contour of the housing 13. In such a liquid ejecting apparatus 10, at the time of connecting the pouring port 30*a* of the liquid containing portion 25 and the liquid replenishment member 45 to each other, when a part of the liquid replenishment member 45 overlaps the document reading device 14 in a case where the apparatus main body 12 is viewed from the side surface 11 side, as compared with a case where a part of the liquid replenishment member 45 does not overlap the document reading device 14, it is possible to reduce the amount of protrusion of the liquid containing portion 25 from the housing 13 and to suppress the increase in the size of the apparatus main body 12 in this point.

(2) At the time of connecting the pouring port 30*a* of the liquid containing portion 25 and the liquid supply portion 45*b* of the liquid replenishment member 45, when bringing the liquid replenishment member 45 into contact with the guide portion 29, the liquid supply portion 45*b* of the liquid replenishment member 45 can be opposed to the pouring port 30*a* of the liquid containing portion 25. As a result, it becomes easier to work to connect the liquid supply portion 45*b* of the liquid replenishment member 45 to the pouring port 30*a* of the liquid containing portion 25.

(3) By making the outer peripheral surface of the bottle main body 45*a* along the recessed portion 29*a* of the guide portion 29, the operation of connecting the liquid supply portion 45*b* of the liquid replenishment member 45 to the pouring port 30*a* of the liquid containing portion 25 is facilitated.

(4) The liquid containing portion 25 is provided at a position where a part of the liquid replenishment member 45 connected to the pouring port 30*a* and the operation unit 20 are overlapped with each other. According to this, the region for providing the operation unit 20 can be used to reduce the protrusion amount of the liquid containing portion 25 from the housing 13.

(5) The cover member 26 is pivotably supported by the key slot 32 which determines the position of the pouring port 30*a*. Therefore, when the cover member 26 is displaced from the opened position to the closed position, the blocking member 28 integral with the cover member 26 is easily brought into contact with the pouring port 30*a*.

(6) Since the mounting member 34 having the blocking member 28 integrated therewith has the clearance S between the first fixing portion 37 and the second fixing portion 38, the position of the blocking member 28 can be aligned with the pouring port 30*a* by using the clearance S.

(7) As the cover member 26 is displaced from the closed position to the opened position, the engagement portion 39 engages with the back surface 24*a* of the front cover 24, so that the front cover 24 can be displaced to be in the opened state from the closed state.

Note that, the above embodiment may be modified as follows. In addition, further modified examples may be made by appropriately combining possible combinations of the respective modified examples below.

In the above embodiment, the cover member 26 may be configured to be opened and closed by pivoting the blocking member 28 from the closed position where the blocking member 28 is brought into contact with the pouring port 30*a* toward the side surface 11 of the apparatus main body 12.

The cover member 26 may be configured to be displaceable between two positions, the opened position and the closed position, by sliding the cover member 26 up and down with respect to the liquid containing portion 25.

In the above embodiment, the blocking member 28 attached to the cover member 26 may be constituted by one blocking member 28 capable of collectively blocking the plurality of pouring ports 30*a*.

A plurality of cover members 26 may be provided according to the number of the liquid containing bodies 30.

The liquid containing body 30 may be provided so as to protrude from the side surface 11 of the apparatus main body 12.

The blocking member 28 may be a member that is blocked by being inserted into the pouring port 30*a*.

The cover member 26 may be configured to be pivotably provided by forming a shaft in the cover member 26 and a bearing in the key slot 32.

The shaft that pivotably supports the cover member 26 protrudes so as to be extended from the side surface of the liquid containing portion 25 instead of the key slot 32. The cover member 26 may be pivotably supported by the liquid containing portion 25 instead of the key slot 32.

The number of the liquid containing body 30 provided in the apparatus main body 12 is not limited to four, and may be one, two, or three, or five or more. In this case, the number of the recessed portions 29*a* of the guide portion 29 is determined according to the number of liquid containing bodies 30 to be provided.

The liquid containing portion 25 itself may constitute one liquid containing body.

The guide portion 29 is not necessarily provided in the apparatus main body 12.

The recessed portion 29*a* of the guide portion 29 is not a circular arc shape but may be a square shape, and the shape of the recessed portion 29*a* is not limited to the shapes in the embodiment.

The notice label 24*b* affixed to the back surface 24*a* of the front cover 24 may not be necessary.

The engagement portion 39 of the cover member 26 may not be necessary.

The first fixing portion 37, the second fixing portion 38, and the mounting member 34 of the cover member 26 may not be necessary, and in this case, the blocking member 28 is directly attached to the mounting surface 26*b* of the cover member 26.

The first fixing portion 37 may be one instead of two, and in this case, one first fixing portion 37 and one second fixing portion 38 constitute a pair of fixing portions.

The medium P is not limited to a sheet but may be a plastic film or the like.

The liquid ejecting apparatus 10 may be a so-called line head type printer in which nozzles are formed over the entire area in the width direction without moving the liquid ejecting head 49, other than the printer having the configuration in which the liquid ejecting head 49 supported by the carriage 48 as a liquid ejecting unit reciprocates along the guide shaft 47 installed inside the housing 13 together with the carriage 48 to be extended in the width direction. Alternatively, it may be a laser printer.

The entire disclosure of Japanese Patent Application No. 2017-250715 filed Dec. 27, 2017 is expressly incorporated by reference herein.

What is claimed is:

1. A liquid ejecting apparatus comprising:

a liquid ejecting unit that ejects a liquid to a medium;

an apparatus main body that includes a housing for containing at least the liquid ejecting unit, and an image reading device disposed on an upper surface of the housing in which an outer surface thereof has an upper surface and a front surface adjacent and intersecting with the upper surface, and a side surface adjacent and intersecting with the front surface and the upper surface;

a liquid containing portion in which a part thereof is located in an external region of the housing, and a pouring port capable of containing the liquid supplied to the liquid ejecting unit to the inside and pouring the liquid from outside; and a cover member capable of being displaced between a closed position at which the pouring port is not exposed and an opened position at which the pouring port is exposed, wherein in a state of being located at the opened position, the cover member is at a position different from a position where the cover member overlaps the apparatus main body in a case where the apparatus main body is viewed from the upper surface side of the image reading device, and wherein the liquid containing portion is provided at a position where at least a part of a liquid replenishment member connected to the pouring port overlaps the image reading device in a case where the apparatus main body is viewed from the side surface side in a state in which the cover member is located at the opened position.

2. The liquid ejecting apparatus according to claim 1, wherein the apparatus main body is provided with a guide portion which is in contact with the liquid replenishment member connected to the pouring port so make a liquid supply portion provided in the liquid replenishment member face the pouring port.

3. The liquid ejecting apparatus according to claim 2, wherein the liquid replenishment member includes a cylindrical bottle main body, and the guide portion has an arcuate recessed portion in a case of being viewed from the upper surface side.

4. The liquid ejecting apparatus according to claim 1, wherein an operation unit for operating the liquid ejecting apparatus is provided on an upper portion of the front surface which corresponds to a top surface of the apparatus main body, and in a case where the apparatus main body is viewed from the side surface side in a state where the cover member is located at the opened position, the liquid containing portion is provided at a position where at least a part of the liquid replenishment member connected to the pouring port overlaps the operation unit.

5. The liquid ejecting apparatus according to claim 1, wherein the cover member includes a blocking member for blocking the pouring port by coming into contact with the pouring port in a state of being located at the closed position, wherein the blocking member is integral with a mounting member mounted on a mounting surface of the cover member, wherein the mounting member is fixed with a clearance between a pair of fixing portions provided on the mounting surface of the cover member, and wherein the cover member is pivotably supported by a key slot which integrally holds a plurality of liquid containing bodies each of which has the pouring port and which is contained in the liquid containing portion, and has an insertion hole into which the liquid replenishment member is inserted so as to face the liquid containing body.

6. The liquid ejecting apparatus according to claim 1, wherein on the front surface corresponding to a top surface of the apparatus main body, an opening for exposing the inside of the housing is provided, and a front cover displaceable between a closed state in which the opening is closed and an opened state in which the opening is opened is pivotably supported, wherein the cover member is provided with an engagement portion, wherein the front cover is provided with an engaged portion engageable with the engagement portion, and wherein the engagement portion is engaged with the engaged portion when the cover member is displaced from the closed position to the opened position.

* * * * *